US008333918B2

(12) United States Patent
Lennon et al.

(10) Patent No.: US 8,333,918 B2
(45) **Date of Patent: *Dec. 18, 2012**

(54) METHOD FOR THE PRODUCTION OF NONWOVEN WEB MATERIALS

(75) Inventors: Eric Edward Lennon, Roswell, GA (US); Thomas William Brock, Woodstock, GA (US); Bryan David Haynes, Advance, NC (US); Douglas Jay Hulslander, Woodstock, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 2273 days.

This patent is subject to a terminal disclaimer.

(21) Appl. No.: 10/694,153

(22) Filed: Oct. 27, 2003

(65) Prior Publication Data

US 2005/0087287 A1 Apr. 28, 2005

(51) Int. Cl.
*B29C 47/00* (2006.01)

(52) U.S. Cl. ..... 264/465; 264/103; 264/555; 264/210.8

(58) Field of Classification Search ..... 264/103, 264/555, 210.8, 465

See application file for complete search history.

(56) References Cited

U.S. PATENT DOCUMENTS

| | | | | |
|---|---|---|---|---|
| 3,052,009 | A * | 9/1962 | Epstein et al. | 28/247 |
| 3,163,753 | A | 12/1964 | Sabato et al. | |
| 3,197,351 | A | 7/1965 | Selby | |
| 3,296,678 | A | 1/1967 | Bundy et al. | |
| 3,302,237 | A | 2/1967 | Cope et al. | |
| 3,325,906 | A | 6/1967 | Franke | |
| 3,338,992 | A | 8/1967 | Kinney | |
| 3,341,394 | A | 9/1967 | Kinney | |
| 3,456,156 | A | 7/1969 | Kilby et al. | |
| 3,563,838 | A | 2/1971 | Edwards | |
| 3,655,305 | A | 4/1972 | Baxter et al. | |
| 3,689,608 | A | 9/1972 | Hollberg et al. | |
| 3,692,618 | A | 9/1972 | Dorschner et al. | |
| 3,711,898 | A | 1/1973 | Debbas | |
| 3,720,741 | A | 3/1973 | Cunningham et al. | |
| 3,802,817 | A | 4/1974 | Matsuki et al. | |

(Continued)

FOREIGN PATENT DOCUMENTS

EP 0950744 A1 10/1999

(Continued)

OTHER PUBLICATIONS

English Translation of WO 00/65134 A1; Translated for the USPTO by McElroy Translation Company Oct. 2009, cover and pp. 1-14.*

(Continued)

*Primary Examiner* — Christina Johnson
*Assistant Examiner* — Patrick Butler
(74) *Attorney, Agent, or Firm* — Dority & Manning, P.A.

(57) ABSTRACT

The present invention provides a method of making a nonwoven web, the method including the steps of providing plurality of fibers and subjecting the fibers to a pneumatic attenuation force which imparts a velocity to the fibers, reducing the velocity of the fibers in a diffusion chamber which is formed substantially between opposed diverging sidewalls, subjecting the fibers to an applied electrostatic charge, and thereafter collecting the fibers into a web on a moving forming surface. The invention also provides an apparatus for forming nonwoven webs, the apparatus comprising a source of fibers, a fiber attenuation chamber, a diffusion chamber formed substantially between opposed diverging sidewalls, the diffusion chamber located below the fiber attenuation chamber, and a forming surface for collecting the fibers as a nonwoven web.

10 Claims, 5 Drawing Sheets

U.S. PATENT DOCUMENTS 3,849,241 A 11/1974 Butin et al.
3,855,046 A 12/1974 Hansen et al.
3,860,369 A 1/1975 Brethauer et al.
3,967,118 A 6/1976 Sternberg
3,979,538 A 9/1976 Gilman et al.
3,991,244 A 11/1976 Debbas
3,993,812 A 11/1976 Debbas et al.
4,009,508 A 3/1977 Sternberg
4,041,203 A 8/1977 Brock et al.
4,086,381 A 4/1978 Cheshire et al.
4,088,726 A 5/1978 Cumbers
4,163,305 A 8/1979 Semjonow et al.
4,170,680 A 10/1979 Cumbers
4,187,586 A 2/1980 Semjonow
4,208,366 A 6/1980 Kinney
4,233,014 A 11/1980 Kinney
4,340,563 A 7/1982 Appel et al.
4,380,104 A 4/1983 Kamioka et al.
4,405,297 A 9/1983 Appel et al.
4,430,277 A 2/1984 Lin
4,517,143 A * 5/1985 Kisler ..... 264/484
4,537,733 A 8/1985 Farago
4,553,996 A 11/1985 Muschelknautz et al.
4,657,793 A 4/1987 Fisher
4,692,106 A 9/1987 Grabowski et al.
4,790,736 A 12/1988 Keuchel
4,810,180 A 3/1989 Isner
4,812,112 A 3/1989 Balk
4,813,864 A 3/1989 Balk
4,820,142 A 4/1989 Balk
4,820,459 A 4/1989 Reifenhäuser
4,838,774 A 6/1989 Balk
4,968,238 A 11/1990 Satterfield et al.
5,032,329 A 7/1991 Reifenhäuser
5,045,248 A 9/1991 Satterfield et al.
5,073,436 A 12/1991 Antonacci et al.
5,108,820 A 4/1992 Kaneko et al.
5,108,827 A 4/1992 Gessner
5,122,048 A 6/1992 Deeds
5,123,983 A 6/1992 Marshall
5,173,356 A 12/1992 Eaton et al.
5,182,162 A 1/1993 Andrusko
5,187,005 A 2/1993 Stahle et al.
5,200,620 A 4/1993 Peritt et al.
5,225,018 A 7/1993 Zeldin et al.
5,256,224 A 10/1993 Gillyns et al.
5,283,097 A 2/1994 Gillyns et al.
5,295,324 A 3/1994 Baba et al.
5,296,172 A 3/1994 Davis et al.
5,308,691 A 5/1994 Lim et al.
5,336,552 A 8/1994 Strack et al.
5,382,400 A 1/1995 Pike et al.
5,397,413 A 3/1995 Trimble et al.
5,439,364 A 8/1995 Gerking et al.
5,460,500 A 10/1995 Geus et al.
5,571,537 A 11/1996 Geus et al.
5,695,377 A 12/1997 Triebes et al.
5,702,730 A 12/1997 Reifenhäuser
5,707,468 A 1/1998 Arnold et al.
5,762,857 A 6/1998 Weng et al.
5,766,646 A 6/1998 Geus et al.
5,807,795 A 9/1998 Lau et al.
5,814,349 A 9/1998 Geus et al.
5,820,888 A 10/1998 Geus et al.
5,853,628 A 12/1998 Varona
5,988,522 A 11/1999 Glezer et al.
5,989,004 A 11/1999 Cook
6,049,956 A 4/2000 Lifke et al.
6,117,379 A * 9/2000 Haynes et al. ..... 264/237
6,379,136 B1 4/2002 Najour et al.
6,386,260 B1 5/2002 Ferencz et al.
6,660,218 B2 * 12/2003 Davis et al. ..... 264/555
6,783,722 B2 * 8/2004 Taylor ..... 264/465
6,966,762 B1 * 11/2005 Maggio et al. ..... 425/66
6,974,316 B2 * 12/2005 Maggio ..... 425/66
7,488,441 B2 * 2/2009 Haynes et al. ..... 264/465
2004/0028763 A1 * 2/2004 Schmit et al. ..... 425/72.2

FOREIGN PATENT DOCUMENTS

FR 2825381 * 5/2001
FR 2825381 * 12/2001
WO WO 93/21370 A1 10/1993
WO WO 00/65134 A1 11/2000
WO WO 01/29295 A1 4/2001
WO WO 02/04719 A1 1/2002
WO WO 02/34990 A1 5/2002
WO WO 02/052071 A2 7/2002
WO WO 02/055778 A1 7/2002
WO WO 02/097182 A1 12/2002
WO WO 03/038174 A1 5/2003

OTHER PUBLICATIONS

English Translation of WO 00/34990 A1; Translated for the USPTO by McElroy Translation Company Oct. 2009, cover and pp. 1-20.*
English Translation of FR 2,825,381 A1; Translated for the USPTO by McElroy Translation Company Oct. 2009, cover and pp. 1-14.*
Ex parte Haynes (B.P.A.I. Appeal No. 2008-3926, U.S. Appl. No. 10/325,140), decided Aug. 26, 2008, pp. 1-11—labeled as Appendix A.*
Ex parte Haynes (B.P.A.I. Appeal No. 2008-1795, U.S. Appl. No. 10/694,420), decided Apr. 30, 2008, pp. 1-7—labeled as Appendix B.*
ASTM Designation: D 5035-90 "Standard Test Method for Breaking Force and Elongation of Textile Fabrics (Strip Method)", Published May 1990, pp. 726-731.

* cited by examiner

METHOD FOR THE PRODUCTION OF NONWOVEN WEB MATERIALS

TECHNICAL FIELD

The present invention is related to a method for forming nonwoven webs, and to an apparatus for forming such webs.

BACKGROUND OF THE INVENTION

Many of the medical care garments and products, protective wear garments, mortuary and veterinary products, and personal care products in use today are partially or wholly constructed of nonwoven web materials. Examples of such products include, but are not limited to, consumer and professional medical and health care products such as surgical drapes, gowns and bandages, protective workwear garments such as coveralls and lab coats, and infant, child and adult personal care absorbent products such as diapers, training pants, swimwear, incontinence garments and pads, sanitary napkins, wipes and the like. For these applications nonwoven fibrous webs provide tactile, comfort and aesthetic properties which can approach those of traditional woven or knitted cloth materials. Nonwoven web materials are also widely utilized as filtration media for both liquid and gas or air filtration applications since they can be formed into a filter mesh of fine fibers having a low average pore size suitable for trapping particulate matter while still having a low pressure drop across the mesh.

Nonwoven web materials have a physical structure of individual fibers or filaments which are interlaid in a generally random manner rather than in a regular, identifiable manner as in knitted or woven fabrics. The fibers may be continuous or discontinuous, and are frequently produced from thermoplastic polymer or copolymer resins from the general classes of polyolefins, polyesters and polyamides, as well as numerous other polymers. Blends of polymers or conjugate multicomponent fibers may also be employed. Nonwoven fibrous webs formed by melt extrusion processes such as spunbonding and meltblowing, as well as those formed by dry-laying processes such as carding or air-laying of staple fibers are well known in the art. In addition, nonwoven fabrics may be used in composite materials in conjunction with other nonwoven layers as in spunbond/meltblown (SM) and spunbond/meltblown/spunbond (SMS) laminate fabrics, and may also be used in combination with thermoplastic films. Nonwoven fabrics may also be bonded, embossed, treated and/or colored to impart various desired properties, depending on end-use application.

Melt extrusion processes for spinning continuous filament yarns and continuous filaments or fibers such as spunbond fibers, and for spinning microfibers such as meltblown fibers, and the associated processes for forming nonwoven webs or fabrics therefrom, are well known in the art. Typically, fibrous nonwoven webs such as spunbond nonwoven webs are formed with the fiber extrusion apparatus, such as a spinneret, and fiber attenuating apparatus, such as a fiber drawing unit (FDU), oriented in the cross-machine direction or "CD". That is, the apparatus is oriented at a 90 degree angle to the direction of web production. The direction of nonwoven web production is known as the "machine direction" or "MD". Although the fibers are laid on the forming surface in a generally random manner, still, because the fibers exit the CD oriented spinneret and FDU and are deposited on the MD-moving forming surface, the resulting nonwoven webs have an overall average fiber directionality wherein more of the fibers are oriented in the MD than in the CD. It is widely recognized that such properties as material tensile strength, extensibility and material barrier, for example, are a function of the material uniformity and the directionality of the fibers or filaments in the web. Various attempts have been made to distribute the fibers or filaments within the web in a controlled manner, attempts including the use of electrostatics to impart a charge to the fibers or filaments, the use of spreader devices to direct the fibers or filaments in a desired orientation, the use of mechanical deflection means for the same purpose, and reorienting the fiber forming means. However, it remains desired to achieve still further capability to gain this control in a way that is consistent with costs dictated by the disposable applications for many of these nonwovens.

SUMMARY OF THE INVENTION

The present invention provides a method of making a nonwoven web including the steps of providing a plurality of fibers, subjecting the fibers to a pneumatic attenuation force in a drawing slot, the attenuation force imparting a velocity to the fibers, reducing the velocity of the fibers in a diffusion chamber, the diffusion chamber being formed substantially between opposed diverging sidewalls, subjecting the fibers to an applied electrostatic charge before the fibers enter the diffusion chamber, wherein the electrostatic charge is applied by two or more oppositely directed electrostatic charging units, and then collecting the fibers into a web on a moving forming surface. One electrostatic charging unit may be located substantially closer to the diffusion chamber than at least one other electrostatic charging unit.

In another embodiment, a method is provided comprising the steps of providing a plurality of fibers, subjecting the fibers to a pneumatic attenuation force in a drawing slot, the attenuation force imparting a velocity to the fibers, reducing the velocity of the fibers in a diffusion chamber, the diffusion chamber being formed substantially between opposed diverging sidewalls, subjecting the fibers to an applied electrostatic charge while the fibers are in the diffusion chamber, the electrostatic charge being applied by at least one electrostatic charging unit located upon a diverging sidewall, and then collecting the fibers into a web on a moving forming surface. The electrostatic charge may applied by two or more oppositely directed electrostatic charging units, where at least one electrostatic charging unit is located upon each of the diverging sidewalls, and at least one electrostatic charging unit may be located substantially closer to the drawing slot than at least one other electrostatic charging unit.

In another embodiment, a method is provided comprising the steps of providing a plurality of fibers, subjecting the fibers to a pneumatic attenuation force in a drawing slot formed between opposed drawing slot sidewalls, the attenuation force imparting a velocity to the fibers, subjecting the fibers to an applied electrostatic charge, the electrostatic charge applied by an electrostatic charging unit located on one of the drawing slot sidewalls, reducing the velocity of the fibers in a diffusion chamber, the diffusion chamber being formed substantially between opposed diverging sidewalls, and then collecting the fibers into a web on a moving forming surface, and where the pneumatic attenuation force is provided by attenuation air entering the drawing slot only from the drawing slot sidewall opposing the drawing slot sidewall upon which the electrostatic charging unit is located.

The invention further provides an apparatus for forming a nonwoven web comprising a source of fibers, a fiber drawing slot formed between opposed slot sidewalls, a diffusion chamber formed substantially between opposed diverging sidewalls, the diffusion chamber located below the drawing slot, two or more oppositely directed electrostatic charging units located above the diffusion chamber, and a forming surface for collecting the fibers as a nonwoven web. At least one of the electrostatic charging units may be located substantially closer to the diffusion chamber than at least one other electrostatic charging unit.

In another embodiment, the apparatus comprises a source of fibers, a fiber drawing slot formed between opposed slot sidewalls, a diffusion chamber formed substantially between opposed diverging sidewalls, the diffusion chamber located below the drawing slot, at least one electrostatic charging unit located upon one of the diverging sidewalls of the diffusion chamber, and a forming surface for collecting the fibers as a nonwoven web. The apparatus may have two or more oppositely directed electrostatic charging units, where at least one electrostatic charging unit is located upon each of the diverging sidewalls, and at least one electrostatic charging unit may be located substantially closer to the drawing slot than at least one other electrostatic charging unit.

In embodiments of any of the above, the opposed diverging sidewalls may desirably be unvented, the pneumatic attenuation force may desirably be provided by perturbed attenuation air, and one or both of the opposed diverging sidewalls may desirably have at least one vortex generator.

DEFINITIONS

Figure 1:
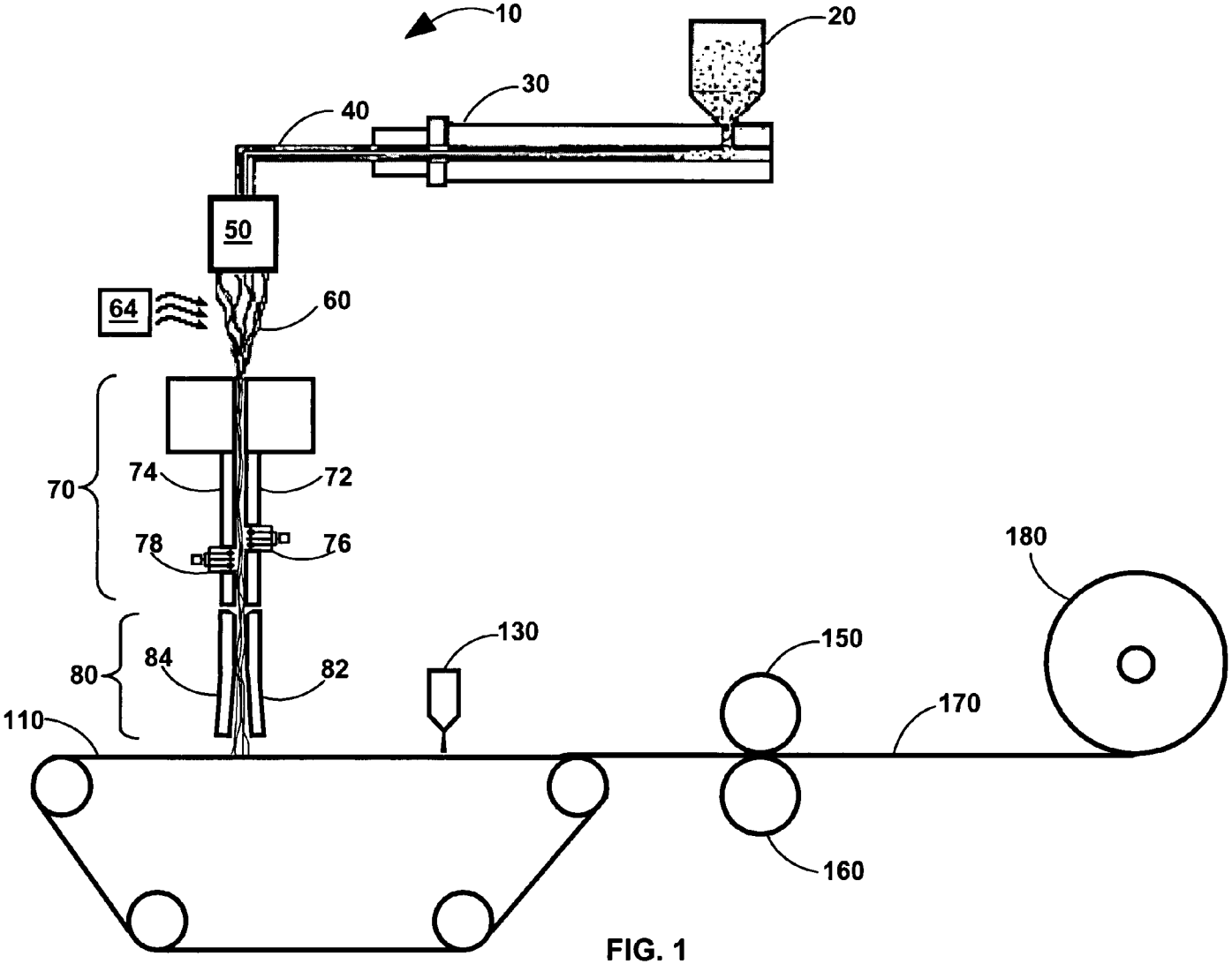
FIG. 1 is a schematic illustration of an exemplary process for producing nonwoven webs.

As used herein and in the claims, the term "comprising" is inclusive or open-ended and does not exclude additional unrecited elements, compositional components, or method steps.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the chemical formula structure. These configurations include, but are not limited to isotactic, syndiotactic and random symmetries.

As used herein the term "fibers" refers to both staple length fibers and continuous fibers, unless otherwise indicated.

As used herein the term "monocomponent" fiber refers to a fiber formed from one or more extruders using only one polymer. This is not meant to exclude fibers formed from one polymer to which small amounts of additives have been added for color, anti-static properties, lubrication, hydrophilicity, etc. These additives, e.g. titanium dioxide for color, are generally present in an amount less than 5 weight percent and more typically about 2 weight percent.

As used herein the term "multicomponent fibers" refers to fibers which have been formed from at least two component polymers, or the same polymer with different properties or additives, extruded from separate extruders but spun together to form one fiber. Multicomponent fibers are also sometimes referred to as conjugate fibers or bicomponent fibers. The polymers are arranged in substantially constantly positioned distinct zones across the cross-section of the multicomponent fibers and extend continuously along the length of the multicomponent fibers. The configuration of such a multicomponent fiber may be, for example, a sheath/core arrangement wherein one polymer is surrounded by another, or may be a side by side arrangement, an "islands-in-the-sea" arrangement, or arranged as pie-wedge shapes or as stripes on a round, oval, or rectangular cross-section fiber. Multicomponent fibers are taught in, for example, U.S. Pat. No. 5,108,820 to Kaneko et al., U.S. Pat. No. 5,336,552 to Strack et al., and U.S. Pat. No. 5,382,400 to Pike et al. For two component fibers, the polymers may be present in ratios of 75/25, 50/50, 25/75 or any other desired ratios.

As used herein the term "biconstituent fiber" or "multiconstituent fiber" refers to a fiber formed from at least two polymers, or the same polymer with different properties or additives, extruded from the same extruder as a blend and wherein the polymers are not arranged in substantially constantly positioned distinct zones across the cross-section of the multicomponent fibers. Fibers of this general type are discussed in, for example, U.S. Pat. No. 5,108,827 to Gessner.

As used herein the term "nonwoven web" or "nonwoven material" means a web having a structure of individual fibers or filaments which are interlaid, but not in an identifiable manner as in a knitted or woven fabric. Nonwoven webs have been formed from many processes such as for example, meltblowing processes, spunbonding processes, air-laying processes and carded web processes. The basis weight of nonwoven fabrics is usually expressed in grams per square meter (gsm) or ounces of material per square yard (osy) and the fiber diameters useful are usually expressed in microns. (Note that to convert from osy to gsm, multiply osy by 33.91).

The term "spunbond" or "spunbond nonwoven web" refers to a nonwoven fiber or filament material of small diameter fibers that are formed by extruding molten thermoplastic polymer as fibers from a plurality of capillaries of a spinneret. The extruded fibers are cooled while being drawn by an eductive or other well known drawing mechanism. The drawn fibers are deposited or laid onto a forming surface in a generally random manner to form a loosely entangled fiber web, and then the laid fiber web is subjected to a bonding process to impart physical integrity and dimensional stability. The production of spunbond fabrics is disclosed, for example, in U.S. Pat. No. 4,340,563 to Appel et al., U.S. Pat. No. 3,692,618 to Dorschner et al., and U.S. Pat. No. 3,802,817 to Matsuki et al. Typically, spunbond fibers or filaments have a weight-per-unit-length in excess of about 1 denier and up to about 6 denier or higher, although both finer and heavier spunbond fibers can be produced. In terms of fiber diameter, spunbond fibers often have an average diameter of larger than 7 microns, and more particularly between about 10 and about 25 microns, and up to about 30 microns or more.

As used herein the term "meltblown fibers" means fibers or microfibers formed by extruding a molten thermoplastic material through a plurality of fine, usually circular, die capillaries as molten threads or fibers into converging high velocity gas (e.g. air) streams which attenuate the fibers of molten thermoplastic material to reduce their diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Buntin. Meltblown fibers may be continuous or discontinuous, are often smaller than 10 microns in average diameter and are frequently smaller than 7 or even 5 microns in average diameter, and are generally tacky when deposited onto a collecting surface.

As used herein, "thermal point bonding" involves passing a fabric or web of fibers or other sheet layer material to be bonded between a heated calender roll and an anvil roll. The calender roll is usually, though not always, patterned on its surface in some way so that the entire fabric is not bonded across its entire surface. As a result, various patterns for calender rolls have been developed for functional as well as aesthetic reasons. One example of a pattern has points and is the Hansen Pennings or "H&P" pattern with about a 30% bond area with about 200 bonds/square inch as taught in U.S. Pat. No. 3,855,046 to Hansen and Pennings. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern is the expanded Hansen and Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Other common patterns include a high density diamond or "HDD pattern", which comprises point bonds having about 460 pins per square inch (about 71 pins per square centimeter) for a bond area of about 15% to about 23% and a wire weave pattern looking as the name suggests, e.g. like a window screen. Typically, the percent bonding area varies from around 10% to around 30% of the area of the fabric laminate web. Thermal point bonding imparts integrity to individual layers by bonding fibers within the layer and/or for laminates of multiple layers, point bonding holds the layers together to form a cohesive laminate.

DETAILED DESCRIPTION OF THE INVENTION

The present invention provides a method for forming fibrous nonwoven webs of high uniformity, and provides an apparatus for forming such nonwoven webs. The invention will be more fully described with reference to the Figures. Turning to FIG. 1, there is illustrated in schematic form in side view an exemplary process for production of a nonwoven web material. In reference to FIG. 1, the process line 10 is described with reference to production of monocomponent continuous fibers, but it should be understood that the present invention also encompasses nonwoven webs made with multicomponent fibers (that is, fibers having two or more components).

The process line 10 includes an extruder 30 for melting and extruding polymer fed into the extruder 30 from polymer hopper 20. The polymer is fed from extruder 30 through polymer conduit 40 to a source of fibers, such as spinneret 50. Spinneret 50 forms fibers 60 which may be monocomponent or multicomponent fibers. Where multicomponent fibers are desired, a second extruder fed from a second polymer hopper would be used. Spinnerets for extruding multicomponent continuous fibers are well known to those of ordinary skill in the art and thus are not described here in detail; however, an exemplary spin pack for producing multicomponent fibers is described in U.S. Pat. No. 5,989,004 to Cook, the entire contents of which are herein incorporated by reference.

Polymers suitable for the present invention include the known polymers suitable for production of nonwoven webs and materials such as for example polyolefins, polyesters, polyamides, polycarbonates and copolymers and blends thereof. Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene; polybutylene, e.g., poly(1-butene) and poly (2-butene); polypentene, e.g., poly(1-pentene) and poly(2-pentene); poly(3-methyl-1-pentene); poly(4-methyl-1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include poly lactide and poly lactic acid polymers as well as polyethylene terephthalate, poly-butylene terephthalate, polytetramethylene terephthalate, polycyclohexylene-1,4-dimethylene terephthalate, and isophthalate copolymers thereof, as well as blends thereof.

The spinneret 50 has openings or capillaries arranged in one or more rows. The spinneret openings form a downwardly extending "curtain" or "bundle" of fibers 60 when polymer is extruded through the spinneret. The exemplary process line 10 in FIG. 1 also includes a quench blower 64 positioned adjacent the curtain of fibers 60 extending from the spinneret 50. Air from the quench air blower 64 quenches the fibers 60 extending from the spinneret 50. The quench air can be directed from one side of the fiber curtain as shown in FIG. 1, or both sides of the fiber curtain. As used herein, the term "quench" simply means reducing the temperature of the fibers using a medium that is cooler than the fibers such as using, for example, chilled air streams, ambient temperature air streams, or slightly to moderately heated air streams. The process may desirably further comprise a means (not shown) to carry away fumes produced from the molten polymer such as a vacuum duct mounted above or otherwise near spinneret 50.

A fiber drawing unit or aspirator 70 to receive the quenched curtain or bundle of fibers is positioned below the spinneret 50 and the quench blower 64. Fiber drawing units or aspirators for use in melt spinning polymers are well known in the art. Suitable fiber drawing units include, for example, linear fiber aspirators of the types shown in U.S. Pat. No. 3,802,817 to Matsuki et al. and U.S. Pat. Nos. 4,340,563 and 4,405,297 to Appel et al., all herein incorporated by reference in their entireties.

Generally described, the fiber drawing unit 70 includes an elongate vertical passage or drawing slot which serves as an attenuation chamber, through which the fibers are drawn by aspirating air entering generally from both of the sides of the passage or drawing slot and flowing downwardly through the passage. The attenuation chamber or fiber drawing slot is formed by opposed plates or sidewalls, designated 72 and 74 in FIG. 1. Opposed sidewalls 72 and 74 will generally be substantially parallel to each other, and in a conventional fiber production apparatus will generally be perpendicular to the horizontal. The fiber drawing unit utilizes a moving pneumatic stream, such as aspirating air supplied by a blower (not shown), to draw the fibers through the slot. The aspirating air may be heated or unheated. The aspirating air applies an attenuation or drawing force on the fibers after the fibers have been extruded from the spinneret 50 and accelerates the fibers. By this application of the pneumatic drawing or attenuation force to accelerate the fibers the fibers are attenuated, that is, reduced in diameter. The aspirating air also acts to guide and pull the curtain or bundle of fibers through the attenuation chamber of the fiber drawing unit 70. Where multicomponent fibers in a crimpable configuration are used and it is desired to activate latent helical crimp in the fibers prior to fiber laydown, the blower supplies heated aspirating air to the fiber drawing unit 70. In this respect, the heated aspirating air both attenuates the fibers and activates the latent helical crimp, as is described in U.S. Pat. No. 5,382,400 to Pike et al., incorporated herein by reference in its entirety. Where multicomponent fibers in a crimpable configuration are used but it is desired to activate the latent helical crimp in the fibers at some point following fiber laydown the blower supplies unheated aspirating air to fiber drawing unit 70, and heat to activate the latent crimp may be supplied to the web at some point after fiber laydown.

As the fibers exit the fiber drawing unit 70 they are passed through a diffuser to reduce the fiber velocity prior to laying the fibers down into a nonwoven web. Shown positioned below the bottom exit of fiber drawing unit 70 is exemplary diffusion chamber 80. Suitable diffusion chambers or diffusers are disclosed in U.S. Pat. No. 5,814,349 to Geus et al., incorporated herein by reference in its entirety. As described in U.S. Pat. No. 5,814,349 it is desirable for the diffuser to be mounted slightly below the exit of the fiber drawing unit to allow for ambient air to be drawn into the diffusion chamber from the sides. As shown in FIG. 1, diffusion chamber 80 is formed between the opposed sidewalls 82 and 84. As can be seen in FIG. 1, the opposed sidewalls 82 and 84 have a divergence, that is, opposed sidewalls 82 and 84 slope outwardly toward the bottom in such a way that the volume expands towards the bottom end of the diffuser. Desirably, the opposed sidewalls 82 and 84 are substantially continuous and unvented, so that air from the jet of attenuation air does not escape from the walls of the diffusion chamber but rather exits the bottom of the diffusion chamber 80 after traveling therethrough. The diverging sidewalls 82 and 84 forming the diffusion chamber 80 as shown in FIG. 1 are substantially parallel to one another in the upper portion of the diffusion chamber and then are inclined or diverge at about a 5 degree angle from the vertical plane at the point where they begin to diverge from one another. However, the sidewalls of the diffusion chamber and thus the angle of divergence are desirably adjustable, and the angle of divergence may be much less than 5 degrees or may be greater than 5 degrees. The gradually expanding or increasing volume of diffusion chamber 80 allows for the jet of fast-moving attenuation air to gradually expand into the increasing volume as it exits the fiber drawing unit 70 and passes through the diffusion chamber 80.

As the pneumatic jet expands in the diffusion chamber 80 it decreases in velocity, and the fiber velocity also decreases, which allows for the fiber bundle to spread out somewhat in the machine direction. That is, as the fiber bundle travels downward through the diffusion chamber, it begins to take on a machine direction dimension which is somewhat larger than it had while between opposed sidewalls 72 and 74 of the attenuation chamber. However, in order to provide for high uniformity of material formation on fiber laydown, it is highly desirable for the machine direction fiber bundle spread to be larger than the bundle spread generated by the diffusion chamber alone. For example, it would be desirable for the fiber bundle to spread out in the machine direction to at least 50 percent of the machine direction dimension of the diffusion chamber 80 at its bottom, as the fibers exit the diffusion chamber 80. It would be more desirable to have the bundle spread be even larger, such as for example to have the bundle spread be 70 percent of the machine direction dimension of the diffusion chamber 80 at its bottom, or even 90 percent, or more.

In order to increase the machine direction fiber bundle spread, one or more electrostatic charging devices as are known in the art may be beneficially employed to impart an electrostatic charge to the fibers of the fiber bundle either as they travel through the fiber drawing slot of fiber drawing unit 70 or as they travel through diffusion chamber 80, or both. Exemplary electrostatic charging units 76 and 78 are shown in opposed relationship located on opposed sidewalls 72 and 74 of the fiber drawing unit 70. As shown in FIG. 1, where opposed electrostatic charging units are utilized they are desirably configured in an offset or staggered relationship such that one electrostatic charging unit is higher or lower in the process than the other. As shown in FIG. 1, electrostatic charging unit 78 is mounted lower on its respective sidewall, i.e., closer to the diffusion chamber, than is electrostatic charging unit 76.

Figure 2A:
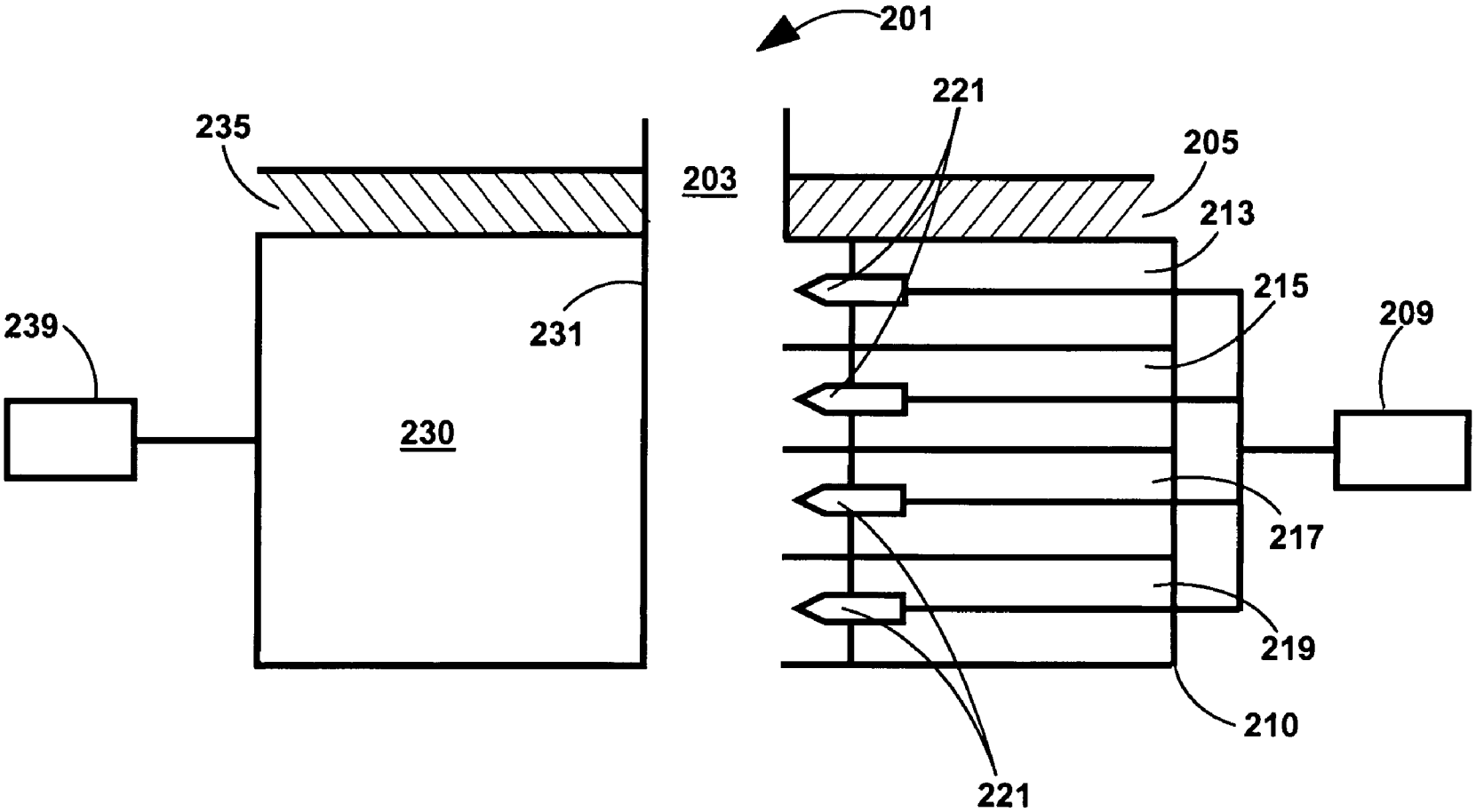
FIG. 2A and FIG. 2B illustrate exemplary devices for applying electrostatic charge to fibers.

Generally described, an electrostatic charging device may consist of one or more rows of electric emitter pins which produce a corona discharge, thereby imparting an electrostatic charge to the fibers, and the fibers, once charged, will tend to repel one another and help prevent groups of individual fibers from clumping or "roping" together. An exemplary process for charging fibers to produce nonwovens with improved fiber distribution is disclosed in co-assigned PCT Pub. No. WO 02/52071 to Haynes et al. published Jul. 4, 2002, the disclosure of which is incorporated herein by reference in its entirety. A closer view of an exemplary electrostatic charging device is shown in FIG. 2A. In FIG. 2A there is shown a side view of a corona discharge arrangement generally designated 201 which is useful in accordance with the invention. The corona discharge arrangement 201 comprises an electrostatic charging device such as electrode array 210 connected to power supply 209. Electrode array 210 comprises multiple bars extending substantially along the cross-machine direction width of the drawing slot of the fiber drawing unit, for example four bars 213, 215, 217 and 219, each of which contains a plurality of recessed emitter pins 221 also extending substantially along the cross-machine direction width of the drawing slot of the fiber drawing unit. The electrode array is desirably separated by electrical insulation 205 from the sidewall upon which it is mounted. The corona discharge arrangement 201 also desirably comprises a target electrode 230 which comprises target plate 231. Target electrode 230 may be grounded or connected to power supply 239 and is desirably separated by electrical insulation 235 from the sidewall upon which it is mounted. Although not visible in FIG. 1, each of electrostatic charging units 76 and 78 is associated with a corresponding target electrode as described with respect to FIG. 2A.

In one exemplary embodiment of a method of making a nonwoven web, the method comprises providing a plurality of fibers; subjecting the fibers to a pneumatic attenuation force in a drawing slot formed between opposed drawing slot sidewalls, the attenuation force imparting a velocity to the fibers; subjecting the fibers to an applied electrostatic charge, the electrostatic charge applied by an electrostatic charging unit located on one of the drawing slot sidewalls; reducing the velocity of the fibers in a diffusion chamber, the diffusion chamber being formed substantially between opposed diverging sidewalls; and thereafter collecting the fibers into a web on a moving forming surface. In this exemplary embodiment, the pneumatic attenuation force is provided by attenuation air entering the drawing slot only from the drawing slot sidewall opposing the drawing slot sidewall upon which the electrostatic charging unit is located.

Figure 3:
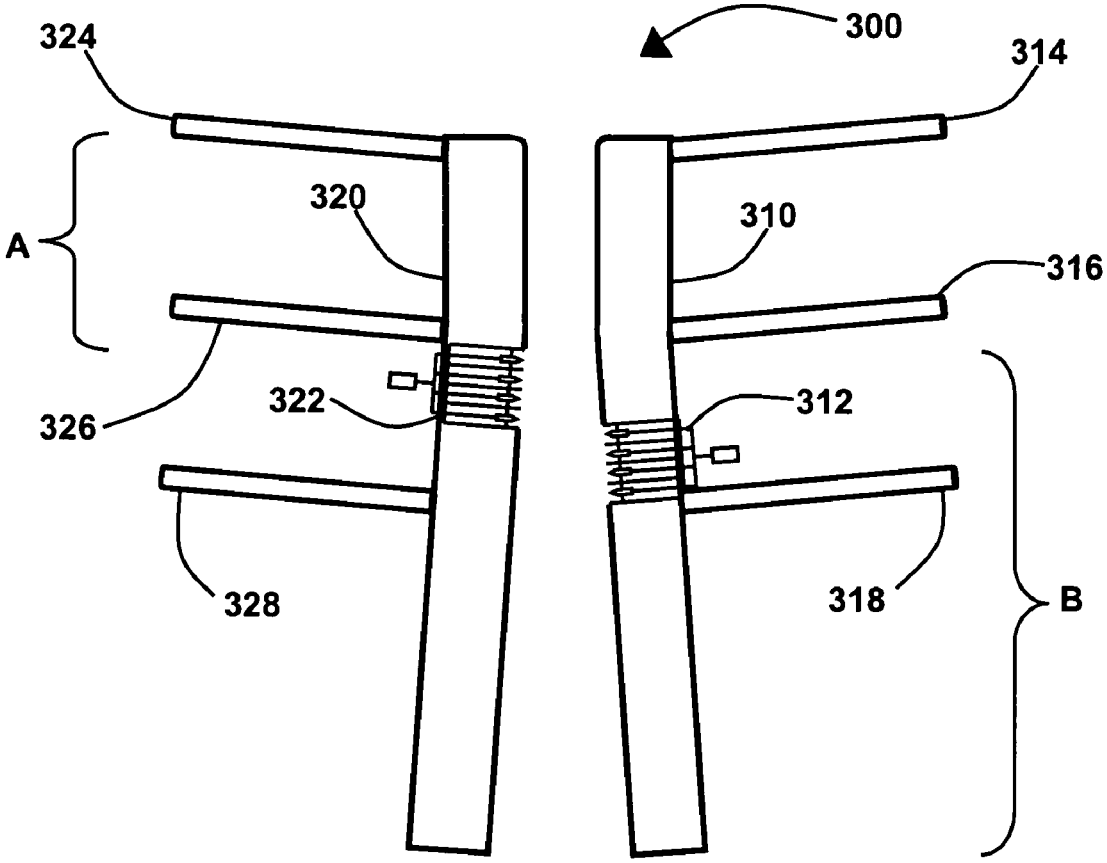
FIG. 3 illustrates a closer view in alternate embodiment of a portion of the exemplary process shown in FIG. 1.

In still another embodiment, to assist machine direction bundle spreading it may be desirable to utilize one or more electrostatic charging units inside the diffuser. Where more than one electrostatic charging unit is utilized inside the diffusion chamber, multiple electrostatic charging units may be located on the same diffusion chamber sidewall. However, it may also be desirable to have at least one electrostatic charging unit located on each sidewall of the diffusion chamber. Where electrostatic charging units are located on both sidewalls, they may be located substantially directly across from one another, that is, the electrostatic charging units may be located at substantially the same vertical height within diffusion chamber 80. However, it may also be advantageous to have the electrostatic charging units in the diffusion chamber located in a staggered configuration, similar to the staggered configuration described with respect to electrostatic charging units 76 and 78 in fiber drawing unit 70 in FIG. 1. FIG. 3 represents an exemplary diffusion chamber and also demonstrates staggering of electrostatic charging units.

In FIG. 3 there is shown a closer side view of an exemplary diffusion chamber, similar to the diffusion chamber 80 which was described with reference to FIG. 1 and positioned below fiber drawing unit 70 in FIG. 1. As mentioned, exemplary diffusers are disclosed in U.S. Pat. No. 5,814,349 to Geus et al. As shown in FIG. 3, the diffusion chamber designated generally 300 is bounded by generally opposed sidewalls 310 and 320. In the embodiment depicted in FIG. 3, located within each sidewall 310 and 320, respectively, is electrostatic charging unit 312 and 322. Electrostatic charging units 312 and 322 are arranged in a staggered pattern or offset configuration. In FIG. 3, electrostatic charging unit 322 is located closer to the drawing slot of the fiber drawing unit (FIG. 1) than electrostatic charging unit 312, i.e., electrostatic charging unit 322 is located higher within the diffusing chamber upon sidewall 320 than is electrostatic charging unit 312 located on sidewall 310. Other configurations and combinations than those shown in FIG. 1 and FIG. 3 are possible. As mentioned, electrostatic charging units may also be located directly across from one another, at substantially the same vertical height within the diffusion chamber. Also, where three or more electrostatic charging units are used, they may continue the staggered pattern as shown in FIG. 3, or may be configured such that certain of the electrostatic charging units are located directly across from one another while other electrostatic charging units are located in a staggered pattern.

Desirably, the sidewalls of the diffusion chamber are capable of adjustment as is shown by adjusting rods 314, 316 and 318 attached to sidewall 310 and adjusting rods 324, 326 and 328 attached to sidewall 320. As shown in FIG. 3, by manipulation of the adjusting rods it is possible to configure the diffusion chamber such that the sidewalls 310 and 320 are substantially parallel to one another for a certain vertical portion of the diffuser (the region of the diffuser marked by bracket A in FIG. 3) before beginning to slope outward or diverge from one another in the region of the diffuser marked in FIG. 3 by bracket B. Also, it is possible to cause the entire length of sidewalls 310 and 320 to diverge from one another along their entire lengths. Other configurations are possible and may be desirable depending on process variables such as rate of fiber production and amount of drawing air to be conducted through the diffusion chamber. For example, it may be desirable to have sidewalls 310 and 320 converge very slightly prior to divergence, producing the cross section of a venturi nozzle or throat, rather than being substantially parallel to one another as described above and as is depicted in FIG. 3.

Returning to FIG. 1, also shown is endless foraminous forming surface 110 which is positioned below the fiber drawing unit 70 and the diffusion chamber 80 to receive the attenuated fibers 100 from the outlet opening of the diffusion chamber 80. A vacuum source (not shown) positioned below the foraminous forming surface 110 may be beneficially employed to pull the attenuated fibers onto foraminous forming surface 110. The fibers received onto foraminous forming surface 110 comprise a nonwoven web of loose continuous fibers, which may desirably be initially consolidated using consolidation means 130 to assist in transferring the web to a bonding device. Consolidation means 130 may be a mechanical compaction roll as is known in the art, or may be an air knife blowing heated air onto and through the web as is described in U.S. Pat. No. 5,707,468 to Arnold, et al., incorporated herein by reference in its entirety.

The process line 10 further includes a bonding device such as the calender rolls 150 and 160 shown in FIG. 1 which may be used to thermally point-bond or spot-bond the nonwoven web as described above. Alternatively, where the fibers are multicomponent fibers having component polymers with differing melting points, through-air bonders such as are well known to those skilled in the art may be advantageously utilized. Generally speaking, a through-air bonder directs a stream of heated air through the web of continuous multicomponent fibers thereby forming inter-fiber bonds by desirably utilizing heated air having a temperature at or above the polymer melting temperature of the lower melting polymer component and below the melting temperature of higher melting polymer component. As still other alternatives, the web may be bonded by utilizing other means as are known in the art such as for example adhesive bonding means, ultrasonic bonding means or entanglement means such as hydroentangling or needling.

Lastly, the process line 10 further includes a winding roll 180 for taking up the bonded web 170. While not shown here, various additional potential processing and/or finishing steps known in the art such as web slitting, stretching, treating, or lamination of the nonwoven fabric into a composite with other materials, such as films or other nonwoven layers, may be performed without departing from the spirit and scope of the invention. Examples of web treatments include electret treatment to induce a permanent electrostatic charge in the web, or in the alternative antistatic treatments. Another example of web treatment includes treatment to impart wettability or hydrophilicity to a web comprising hydrophobic thermoplastic material. Wettability treatment additives may be incorporated into the polymer melt as an internal treatment, or may be added topically at some point following fiber or web formation. Still another example of web treatment includes treatment to impart repellency to low surface energy liquids such as alcohols, aldehydes and ketones. Examples of such liquid repellency treatments include fluorocarbon compounds added to the web or fibers of the web either topically or by adding the fluorocarbon compounds internally to the thermoplastic melt from which the fibers are extruded. In addition, as an alternative to taking the nonwoven web up on winding roll 180, the nonwoven web may be directed to various converting or product forming operations without winding.

Figure 4:
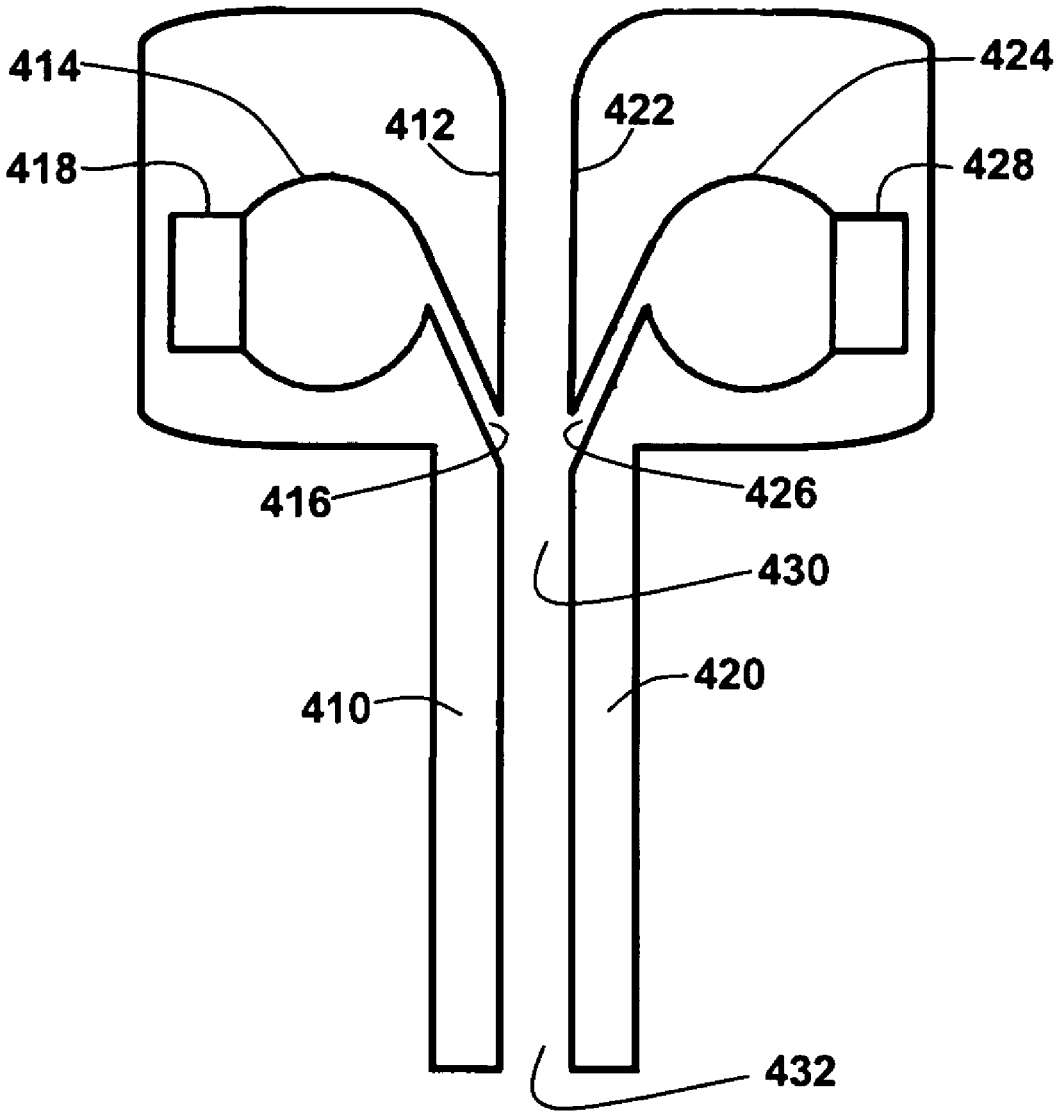
FIG. 4 illustrates a closer view in alternate embodiment of a portion of the exemplary process shown in FIG. 1.

In still another embodiment, the uniformity of the nonwoven web formation may be further improved or enhanced by perturbing the attenuating air which is supplied to the fiber drawing unit. FIG. 4 shows in closer cross-sectional side view an illustration of an exemplary eductive slot draw unit such as the fiber drawing unit 70 which was shown in FIG. 1. As illustrated in FIG. 4, opposed sidewalls 410 and 420 are substantially perpendicular to the horizontal and substantially parallel to one another and define between them an elongate drawing slot or attenuation chamber 430 through which the fibers pass prior to exiting the attenuation chamber at exit 432 and entering the diffusion chamber (FIG. 1). Also defining the attenuation chamber 430 are upper eductor sides 412 and 422. High velocity air is admitted into the attenuation chamber to draw or attenuate the fibers via either or both of air plenums 414 and 424 through nozzle gaps 416 and 426. Nozzle gaps 416 and 426 are defined respectively by the space or gap between upper eductor side 412 and sidewall 410, and upper eductor side 422 and sidewall 420. Air may be supplied to air plenums 414 and 424 by one or more blowers or pumps (not shown). The air admitted to the attenuation chamber via nozzle gaps 416 and 426 may desirably be perturbed to enhance the machine direction bundle spread of the fibers by the use of one or more mechanical perturbation valves which alternatingly perturb the air flow being fed into the two plenums, which serves to alternatingly augment the pressure of the air within the two plenums. Such perturbation of drawing air is described in U.S. Pat. No. 5,807,795 to Lau et al., incorporated herein by reference in its entirety, and may be desirably employed with electrostatic charging units located in either the fiber drawing slot or in the diffusion chamber.

As an alternative and/or in addition to using perturbation valves, the transducers 418 and 428 shown in FIG. 4 as are disclosed in the above-mentioned U.S. Pat. No. 5,807,795 may be used. Transducers 418 and 428 may be actuated by means of an electrical signal. For example, the transducers may actually be large speakers which receive an electrical signal to activate 0° to 180° out of phase in order to provide the alternating augmented pressures in air plenums 414 and 424. However, any type of appropriate transducer may create an augmented air flow by using any means of actuation. This may include but is not limited to electromagnetic means, hydraulic means, pneumatic means or mechanical means.

In still another embodiment, a single electrostatic charging unit may be used, in either the diffusion chamber or in the fiber drawing slot, in conjunction with using specific application of aerodynamic forces to balance the repulsion forces created by the electrostatic charging unit. As an example, although it was stated above with reference to FIG. 1 that the fibers are drawn through the drawing slot of the fiber drawing unit by aspirating air entering generally from both sides of the passage, where an electrostatic charging unit is located, for example, only on one of the walls forming the drawing slot of the fiber drawing unit, we have found that the fiber bundle spread in the machine direction may be enhanced by utilizing attenuation air entering the fiber drawing unit only from the opposing sidewall of the attenuation chamber or fiber drawing slot. As a specific example and using FIG. 4 as a reference, an electrostatic charging unit may be located on sidewall 420 to subject fibers to an electrostatic charge before the fibers exit drawing slot or attenuation chamber 430 at exit 432. In this instance and for this embodiment, because the electrostatic charging unit is located on sidewall 420 then the aspirating air may be supplied by only nozzle gap 416 in the opposing sidewall 410.

In still another embodiment, the uniformity of the nonwoven web formation may be further improved or enhanced by utilizing vortex generators on or near the inner surface of the diverging sidewalls of the diffusion chamber. Vortex generators may be placed along one or more walls at spaced apart locations across the cross machine direction of the sidewall, to induce vortices into the airstream. The vortices induced will act to increase turbulence in the inner layer of the airstream close to the sidewall, adding energy to the flow in that area, and reduce flow separation, allowing for the airstream to more effectively conform to the sidewalls as the sidewalls diverge, and thus providing for a more complete machine direction dispersion of the airstream and consequently a larger machine direction fiber bundle spread. Vortices may be generated by having tabs or protrusions on one or more sidewalls at spaced apart locations, such as are described in U.S. Pat. No. 5,695,377 to Triebes et al., incorporated herein by reference in its entirety. Depending on placement of the vortex generators and amount of machine direction fiber bundle spread inside the diffusion chamber, catching or dragging of the fibers upon the vortex generators may be an issue. In that instance, it may be desirable to utilize as vortex generators dimples or inverted tabs which extend into the surface of the material forming the sidewall, rather than vortex generators which extend outwardly from the inner surface of the sidewall into the diffusion chamber.

Other methods of vortex generation may be employed with or in place of those described above. For example, one or more backward facing steps running substantially the cross-machine direction width of the diffusion chamber may be used on the inner sidewall surface to generate vortices. As another example, air jets may be used on one or both sidewalls to generate vortices by blowing fine jets of a fluid such as air through pores or holes drilled or otherwise formed in the sidewall surface material. As an alternative to actual air jets, synthetic jets such as are generally described in U.S. Pat. No. 5,988,522 to Glezer et al., incorporated herein by reference in its entirety, may be used on one or both sidewalls to generate vortices. Generally described, a synthetic jet may be produced from a fluid-filled chamber having a flexible actuatable membrane at one end and a more rigid wall at the other end, the rigid wall having a small hole. The flexible membrane may then be repeatedly actuated by acoustical wave energy, mechanical energy or piezoelectric energy, thereby causing a jet of fluid (such as air) to emanate from the hole in the more rigid wall at the other end of the chamber.

Although the invention has been described above primarily with respect to eductively-fed slot type fiber drawing units having substantially parallel sides, we believe its utility is not so limited and that it would be useful with other types of slot-draw fiber drawing systems. For example, we believe the non-eductive fiber drawing systems or linear fiber aspirators such as are described in U.S. Pat. Nos. 4,340,563 and 4,405,297 to Appel et al., and fiber drawing systems with stretching chamber walls having a generally venturi nozzle-like cross section will also benefit, such as those described in U.S. Pat. No. 4,692,106 to Grabowski et al. and U.S. Pat. No. 4,838,774 to Balk, both incorporated herein by reference in their entireties.

As another embodiment of the present invention, the nonwoven web materials may be used in a laminate that contains at least one layer of nonwoven web and at least one additional layer such as a woven fabric layer, an additional nonwoven fabric layer, a foam layer or film layer. The additional layer or layers for the laminate may be selected to impart additional and/or complementary properties, such as liquid and/or microbe barrier properties. The laminate structures, consequently, are highly suitable for various uses including various skin-contacting applications, such as protective garments, covers for diapers, adult care products, training pants and sanitary napkins, various drapes, surgical gowns, and the like. The layers of the laminate can be bonded to form a unitary structure by a bonding process known in the art to be suitable for laminate structures, such as a thermal, ultrasonic or adhesive bonding process or mechanical or hydraulic entanglement processes.

As an example, a breathable film can be laminated to the nonwoven web to provide a breathable barrier laminate that exhibits a desirable combination of useful properties, such as soft texture, strength and barrier properties. As another example the nonwoven web can be laminated to a non-breathable film to provide a strong, high barrier laminate having a cloth-like texture. These laminate structures provide desirable cloth-like textural properties, improved strength properties and high barrier properties. Another laminate structure highly suitable for the present invention is the spunbond-meltblown-spunbond laminate material such as is disclosed in U.S. Pat. No. 4,041,203 to Brock et al., which is herein incorporated in its entirety by reference.

The nonwoven web materials made by the present invention are highly suitable for various uses, such as for example uses including disposable articles as described above, e.g., protective garments, sterilization wraps, surgical garments, and wiper cloths, and liners, covers and other components of absorbent articles.

The following examples are provided for illustration purposes and the invention is not limited thereto.

EXAMPLE

Example and Comparative spunbonded nonwoven webs were produced using commercially available isotactic polypropylene of approximately 35 melt flow rate, available from ExxonMobil Chemical Co. (Houston, Tex.) and designated as Exxon 3155. Materials were produced at basis weights of about 0.5 osy (about 17 gsm) (Examples 1 and 2, Comparatives 1 and 2) and about 0.4 osy (about 14 gsm) (Example 3 and Comparative 3) using a spunbond type slot-draw nonwoven spinning system such as described in the above-mentioned U.S. Pat. No. 3,802,817 to Matsuki et al. and, after being collected on a forming surface, all materials were thermally bonded using a calender having an HDD type bond pattern as described above. For all materials, the fibers had an average diameter of about 17-18 microns (about 1.8-2.0 denier). The Example and Comparative materials were made at polymer throughput rates of 11.0 pounds per spinplate transverse inch per hour ("PIH") (about 196 kg/meter/hour) and 13.9 PIH (about 248 kg/meter/hour). The particular polymer throughput rate for each material is designated in TABLE 1. Comparative materials 1-3 were made by drawing fibers in a fiber drawing unit drawing slot and charging the fibers with a single electrostatic charging unit and using a segmented mechanical deflector target electrode substantially as is described in co-assigned PCT Pub. No. WO 02/52071 to Haynes et al. For the Example materials, an electrostatic charging apparatus and diffusion chamber were used as is described below.

Figure 2B:
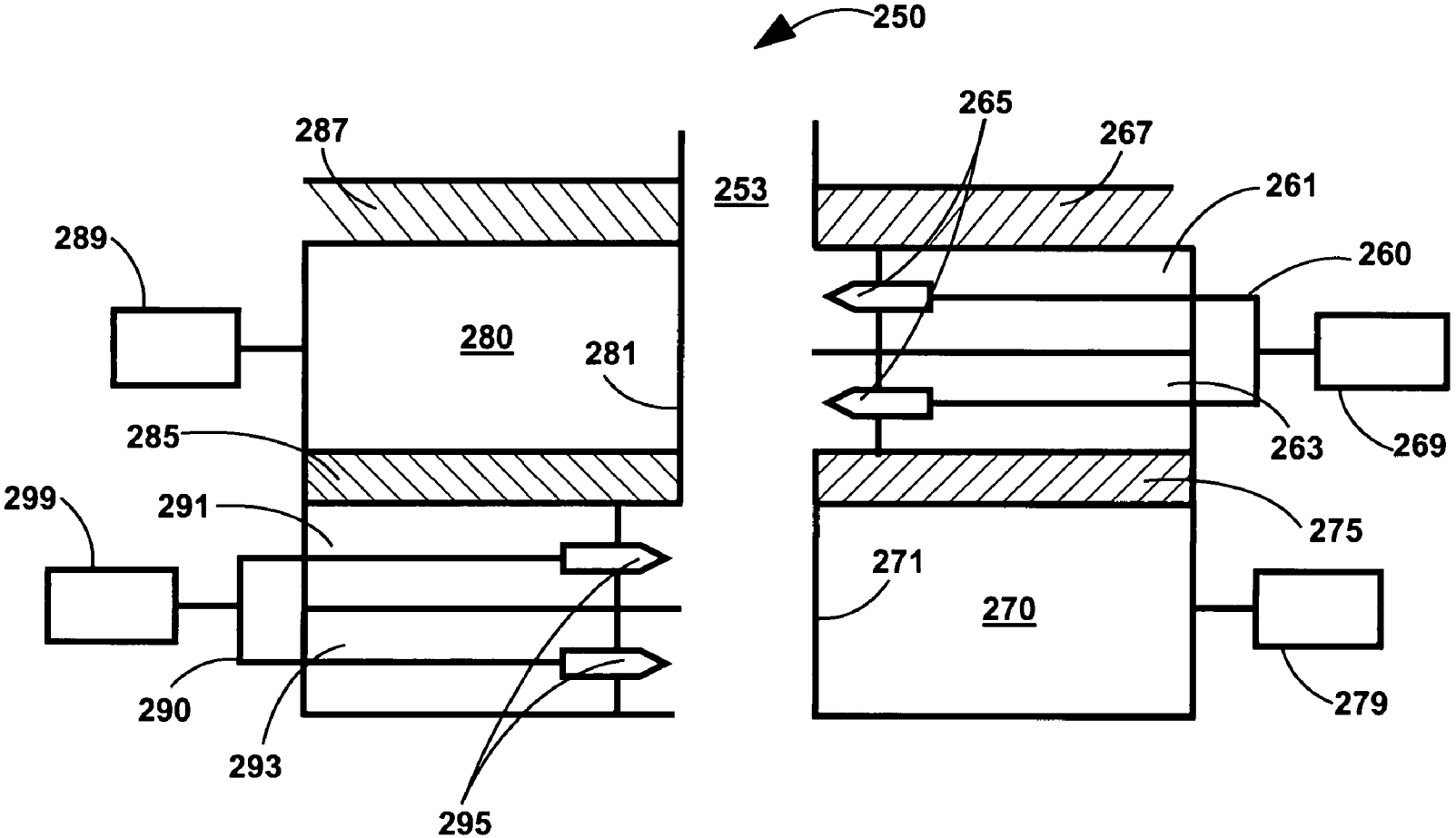

For the Example materials, an electrostatic charging system was located near the fiber drawing unit drawing slot exit to charge the filament curtain as generally described in PCT Publication WO 02/52071 to Haynes et al. and as described herein with reference to FIG. 1, wherein the fibers were subjected to an applied electrostatic charge before the fibers entered the diffusion chamber. However, the specific apparatus used for charging the fibers is illustrated schematically in FIG. 2B, and no segmented mechanical deflector was used. In FIG. 2B there is shown a side view of a corona discharge arrangement generally designated 250. The electrostatic charging apparatus was located near the exit 253 of the fiber drawing unit drawing slot (not shown in FIG. 2B). The corona discharge arrangement 250 comprised two electrostatic charging devices in a staggered configuration having electrode arrays 260 and 290 connected to respective power supplies 269 and 299. Each electrode array comprised two bars extending substantially along the cross-machine direction width of the fiber drawing unit as is shown by bars 261 and 263 for electrode array 260 and bars 291 and 293 for array 290. Each bar contained a plurality of recessed emitter pins 265 (array 260) and 295 (array 290) also extending substantially along the cross-machine direction width of the fiber drawing unit. The fiber drawing unit sidewalls were separated from the electrostatic charging apparatus by electrical insulation 287 and 267. Each electrode array was associated with a corresponding opposed target electrode 270 and 280 having target plates 271 and 281, respectively. The electrostatic charging apparatus was grounded. However, it should be noted that the target electrodes could also desirably be connected to power supplies 279 and 289. Electrical insulation 275 was placed between electrode array 260 and target electrode 270, and electrical insulation 285 was placed between electrode array 290 and target electrode 280.

Also for the production of Examples 1-3, a diffusion chamber or diffuser substantially as described in U.S. Pat. No. 5,814,349 to Geus et al. and as hereinabove described with respect to FIG. 1 and FIG. 3 (except that no electrostatic charging units were located within the diffuser) was located below the fiber drawing unit drawing slot. The diffusion chamber was mounted slightly lower than the exit of the fiber drawing unit to allow for ambient air to be drawn into the diffusion chamber. The adjusting rods were set on the diffuser to produce a slight convergence of the diffusion chamber sidewalls (producing the cross section of a venturi nozzle), before the sidewalls diverged. The sidewall spacing at the top of the diffusion chamber was about 1.55 inches (about 3.94 cm). The minimum sidewall spacing in the diffusion chamber was about 1.35 inches (about 3.43 cm), before diverging out to a maximum sidewall spacing of about 3.15 inches (about 8 cm) at the bottom or exit of the diffusion chamber. From the point of minimum sidewall spacing or convergence the sidewalls were angled outward at approximately 1.5 degrees from vertical to create the stated maximum divergence at the bottom of the diffusion chamber.

A second set of Comparative materials, Comparatives 4 and 5, was made with both materials having a basis weight of about 0.50 osy (about 17 gsm) and utilizing the same fiber drawing unit and diffusion chamber and processing parameters as for Examples 1 and 2 except that no electrostatic charge was applied to the fibers during production of Comparative materials 4 and 5.

All the Comparative and Example materials were tested for peak tensile strength (highest force encountered when extending the material sample during the test) in the machine direction ("MD") and in the cross machine direction ("CD") using the strip tensile test method. Tensile strength testing was performed using a Sintech 2/S tensile tester available from the SinTech Corporation (Carey, N.C.) in accordance with ASTM-D-5035-90, except that 3 inch (76.2 mm) wide by 6 inch (152.4 mm) long cut strip samples were used instead of the one inch (25.4 mm) or two inch (50.8 mm) wide samples specified in procedure D-5035-90. The materials were tested for tensile strength in each of the CD and MD directions and the results of fifteen repetitions for each sample in each direction were averaged for each material. The results for the tensile testing are shown in TABLE 1 and TABLE 2 and are reported as the load in grams required to extend the material.

In the TABLES, Example and Comparative materials having the same basis weight and produced at the same polymer throughput rate are compared. For example, in TABLE 1, Example 1 is compared to Comparative 1 because both were approximately 0.50 osy (17 gsm) webs and both were produced at a polymer throughput rate of about 11.0 PIH (about 196 kg/meter/hour), Example 2 is compared to Comparative 2, and so on. As can be seen in TABLE 1, for each Example-Comparative pairing, the cross machine direction (CD) tensile strength is significantly higher in the Example materials than in the Comparative materials, for both basis weights of material tested and for both polymer throughput rates at which the materials were produced.

TABLE 1

| Material | Throughput (kg/m/hr) | BW (gsm) | CD Tensile (grams) | MD:CD Ratio | % CD Increase |
|---|---|---|---|---|---|
| EX. 1 | 196 | 17 | 3633 | 2.12 | 34.62 |
| Comp. 1 | 196 | 17 | 2699 | 2.99 | — |
| EX. 2 | 248 | 17 | 2740 | 2.96 | 43.13 |
| Comp. 2 | 248 | 17 | 1914 | 2.99 | — |
| Ex. 3 | 248 | 14 | 1914 | 3.05 | 22.32 |
| Comp. 3 | 248 | 14 | 1565 | 3.12 | — |

The tensile strengths of Examples 1 and 2 are also shown compared to the Comparatives 4 and 5 in TABLE 2. All materials listed in TABLE 2 were the same basis weight, about 0.50 osy (about 17 gsm). Each Example material is compared to the Comparative material produced at the same polymer throughput rate. For example, Example 1 is compared to Comparative 4 because both were produced at a polymer throughput rate of about 11.0 PIH (about 196 kg/meter/hour) and Example 2 is compared to Comparative 5. For the Example materials the total material tensile (i.e., the combined CD plus MD tensile strengths) was higher than for the Comparative materials. It can also be seen that the amount of increase in total tensile became more favorable as the material production rates increased from 196 to 248 kilogram/meter/hour. It was also noted upon visual inspection of the materials that the formation of the Example materials appeared more uniform than the Comparative materials of the same basis weight, and that this uniformity difference became even more pronounced as the material production rates increased from 196 to 248 kilogram/meter/hour.

TABLE 2

| Material | Throughput (kg/m/hr) | CD Tensile (grams) | MD Tensile (grams) | MD + CD (grams) | Percent Increase |
|---|---|---|---|---|---|
| EX. 1 | 196 | 3633 | 7703 | 11336 | 3.14 |
| Comp. 4 | 196 | 3651 | 7339 | 10991 | — |
| EX. 2 | 248 | 2740 | 8109 | 10849 | 9.94 |
| Comp. 5 | 248 | 2667 | 7201 | 9868 | — |

Numerous other patents have been referred to in the specification and to the extent there is any conflict or discrepancy between the teachings incorporated by reference and that of the present specification, the present specification shall control. Additionally, while the invention has been described in detail with respect to specific embodiments thereof, it will be apparent to those skilled in the art that various alterations, modifications and/or other changes may be made without departing from the spirit and scope of the present invention. It is therefore intended that all such modifications, alterations and other changes be encompassed by the claims.

The invention claimed is:

1. A method of making a nonwoven web, the method comprising:

a) providing a plurality of fibers;

b) subjecting the fibers to a pneumatic attenuation force in a drawing slot, the attenuation force imparting a velocity to the fibers;

c) reducing the velocity of the fibers in a diffusion chamber that is spaced from an exit of the drawing slot in a direction of travel of the plurality of fibers, the diffusion chamber being formed substantially between opposed diverging sidewalls;

d) subjecting the fibers to an applied electrostatic charge before the fibers enter the diffusion chamber, wherein the electrostatic charge is applied by two or more oppositely directed electrostatic charging units with each charging unit including an emitter device and a target device such that at least one emitter device is configured on each side of the fibers so that an electrostatic charge is generated from opposite directions transverse to the direction of travel of the plurality of fibers; and thereafter e) collecting the fibers into a web on a moving forming surface.

2. The method of claim 1 wherein the electrostatic charging units are in a staggered configuration.

3. The method of claim 1 wherein the opposed diverging sidewalls are unvented.

4. The method of claim 1 wherein the pneumatic attenuation force is provided by perturbed attenuation air.

5. The method of claim 1 wherein at least one of the opposed diverging sidewalls comprises at least one vortex generator.

6. A method of making a nonwoven web, the method comprising:

a) providing a plurality of fibers;

b) subjecting the fibers to a pneumatic attenuation force in a drawing slot, the attenuation force imparting a velocity to the fibers;

c) reducing the velocity of the fibers in a diffusion chamber, the diffusion chamber being formed substantially between opposed diverging sidewalls;

d) subjecting the fibers to and charging the fibers with an applied electrostatic charge while the fibers are in the diffusion chamber, the electrostatic charge being applied by two or more oppositely directed electrostatic charging units wherein at least one electrostatic charging unit includes an emitter device located upon a first one of the diverging sidewalls and a target device located on the opposite diverging wall and a second electrostatic charging unit includes a target device on the first one of the diverging sidewalls and an emitter device on the opposite diverging sidewall so that electrostatic charge is generated from opposite directions between the diverging sidewalls with respect to the direction of travel of the plurality of fibers through the diversion chamber; and thereafter e) collecting the fibers into a web on a moving forming surface.

7. The method of claim 6 wherein at least one electrostatic charging unit is located substantially closer to the drawing slot than at least one other electrostatic charging unit.

8. The method of claim 6 wherein the pneumatic attenuation force is provided by perturbed attenuation air.

9. The method of claim 6 wherein the opposed diverging sidewalls are unvented.

10. The method of claim 6 wherein at least one of the opposed diverging sidewalls comprises at least one vortex generator.

* * * * *